US008376530B2

(12) United States Patent
Lin

(10) Patent No.: US 8,376,530 B2
(45) Date of Patent: Feb. 19, 2013

(54) INK FILLING DEVICE FOR OFFICE MACHINE

(75) Inventor: Ting Kuang Lin, Taichung (TW)

(73) Assignee: Chia Hsiang Art Printing Co., Ltd., Situn Taichung (TW)

( * ) Notice: Subject to any disclaimer, the term of this patent is extended or adjusted under 35 U.S.C. 154(b) by 113 days.

(21) Appl. No.: 12/930,120

(22) Filed: Dec. 29, 2010

(65) Prior Publication Data

US 2012/0169811 A1 Jul. 5, 2012

(51) Int. Cl.
*B41J 2/175* (2006.01)
*B41J 29/38* (2006.01)
*B41J 2/17* (2006.01)

(52) U.S. Cl. ..... 347/85; 347/7; 347/84; 347/86

(58) Field of Classification Search ..... 347/7, 84, 347/85, 86

See application file for complete search history.

(56) References Cited

U.S. PATENT DOCUMENTS

| | | | | |
|---|---|---|---|---|
| 4,577,200 | A | 3/1986 | Rix et al. | |
| 5,531,055 | A * | 7/1996 | Sell et al. | 347/85 |
| 6,145,968 | A * | 11/2000 | Fries et al. | 347/85 |
| 6,273,151 | B1 * | 8/2001 | Kong | 347/85 |
| 2004/0061748 | A1 * | 4/2004 | Kuwabara et al. | 347/85 |

* cited by examiner

*Primary Examiner* — Jannelle M LeBron
(74) *Attorney, Agent, or Firm* — Charles E. Baxley

(57) ABSTRACT

An ink filling device for supplying an ink to an ink container of an office machine includes an ink reservoir having an inlet port and one or more outlet openings, an ink casing having a filling member for engaging with the inlet port and for supplying the ink into the ink reservoir, and a connecting device includes a coupling pipe having one end for coupling to the outlet opening of the ink reservoir, and having the other end for coupling to the ink container of the office machine and for automatically filling the ink container of the office machine and for maintaining the ink container in the full or filled level without being filled or operated by the users themselves.

4 Claims, 6 Drawing Sheets

INK FILLING DEVICE FOR OFFICE MACHINE

BACKGROUND OF THE INVENTION

1. Field of the Invention

The present invention relates to an ink filling device for an office machine, and more particularly to an ink filling device including an ink reservoir coupled to an ink container of the office machine for automatically filling the ink container of the office machine and for maintaining the ink container in the full or filled level without being filled or operated or actuated by the users themselves.

2. Description of the Prior Art

Typical office machines, such as printers, plotters, painting machines, drawing facilities or the like comprise a printing head coupled to an ink container which is provided for receiving or containing the ink therein and for supplying the ink to the printing head.

For example, U.S. Pat. No. 4,577,200 to Rix et al. discloses one of the typical cassettes for the ink jet printers of the office machines and comprising an ink container permanently connected to a dot matrix printing head component of a printing head for suitably supplying the ink to the dot matrix printing head component of the printing head.

The ink contained in the ink container will be consumed quickly, and a number of additional ink cassettes or casings are further required to be provided and attached or connected or coupled to the ink container for refilling or supplying the ink into the ink container after the ink contained in the previous or original ink container has been consumed.

However, the additional ink cassettes or casings should be discarded after use or after the ink has been filled or supplied into the ink container, and will seriously pollute our environment if the additional ink cassettes or casings may not be suitably reused or recycled.

The present invention has arisen to mitigate and/or obviate the afore-described disadvantages of the conventional ink refilling problems.

SUMMARY OF THE INVENTION

The primary objective of the present invention is to provide an ink filling device including an ink reservoir coupled to an ink container of the office machine for automatically filling the ink container of the office machine and for maintaining the ink container in the full or filled level without being filled or operated by the users themselves.

In accordance with one aspect of the invention, there is provided an ink filling device for supplying an ink to an ink container of an office machine, the ink filling device comprising an ink reservoir including a chamber formed therein for receiving the ink therein, and including an inlet port, and including at least one outlet opening, an ink casing including a filling member for engaging with the inlet port and for supplying the ink into the chamber of the ink reservoir, and a connecting device including a coupling pipe having a first end for coupling to the outlet opening of the ink reservoir, and having a second end for coupling to the ink container of the office machine and for automatically filling the ink container of the office machine and for maintaining the ink container in the full or filled level without being filled or operated by the users themselves.

The ink reservoir includes a cover mounted on top for enclosing the ink reservoir. The inlet port and the outlet opening of the ink reservoir are provided in the cover of the ink reservoir for coupling to the ink casing and the ink container of the office machine respectively.

The ink reservoir includes an outlet tube engaged into the chamber of the ink reservoir and coupled to the outlet opening of the ink reservoir, and the outlet tube includes a mouth piece extended out of the cover for coupling to the ink container of the office machine with the connecting device, and includes a lower end spaced from a bottom wall of the ink reservoir for preventing the dirt or contaminant received or contained in the chamber of the ink reservoir from entering or flowing out through the outlet tube and from flowing into the ink container of the office machine.

The ink reservoir includes a lid for selectively attaching to the mouth piece of the outlet tube and for selectively enclosing and sealing the mouth piece of the outlet tube.

The ink casing includes a cap attached thereto, and the filling member is extended from the cap, and the ink casing includes a control valve attached to the filling member for controlling the ink through the filling member and from the ink casing to the chamber of the ink reservoir.

The connecting device includes a quick coupling device attached to the coupling pipe for quickly connecting the ink reservoir to the ink container of the office machine.

Further objectives and advantages of the present invention will become apparent from a careful reading of the detailed description provided hereinbelow, with appropriate reference to the accompanying drawings.

BRIEF DESCRIPTION OF THE DRAWINGS

FIG. 1 is a perspective view of an ink filling device in accordance with the present invention for an office machine or the like;

DETAILED DESCRIPTION OF THE PREFERRED EMBODIMENT

Figure 1:
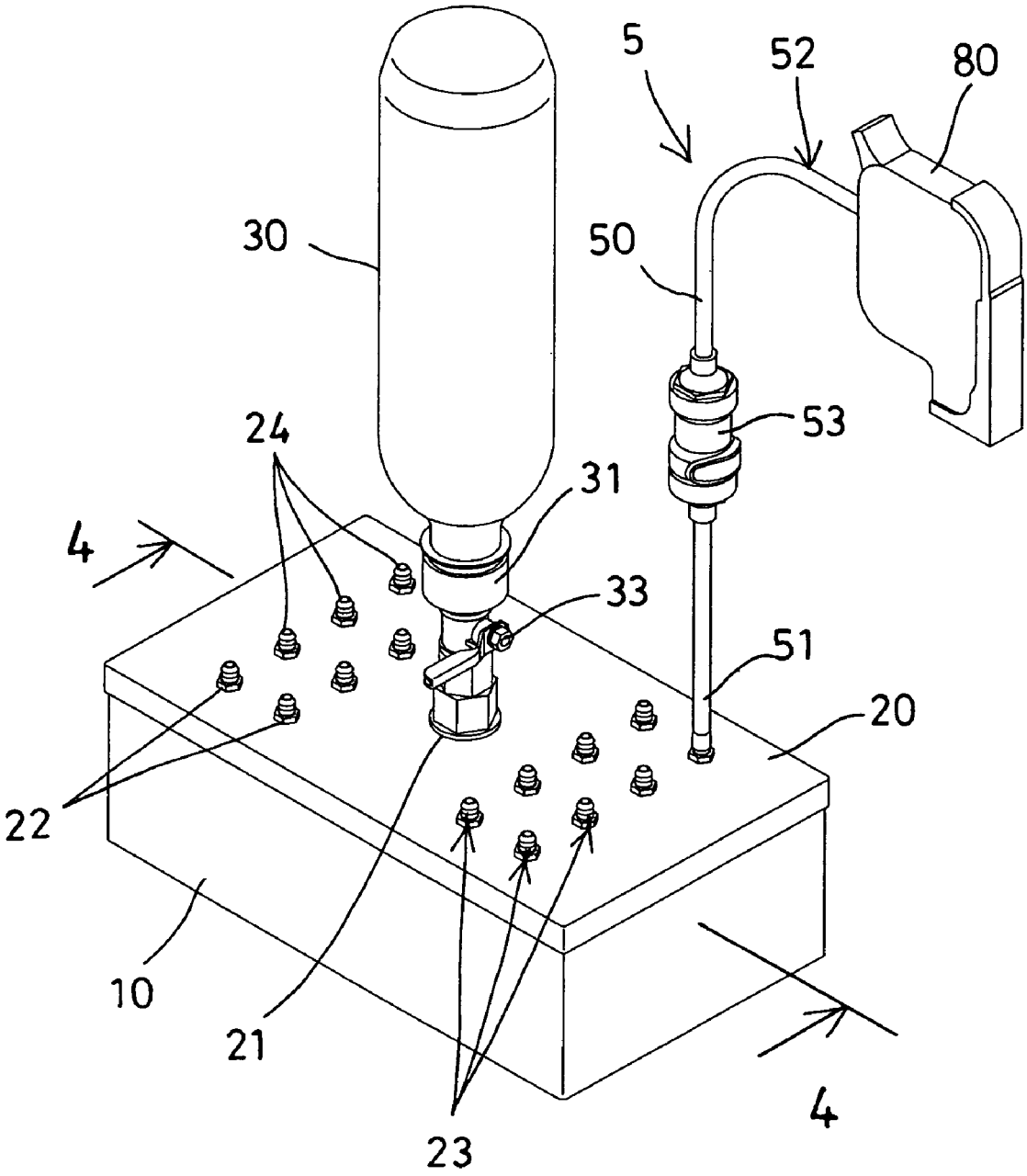

Referring to the drawings, and initially to FIGS. 1-4, an ink filling device in accordance with the present invention comprises an ink reservoir 10 for coupling to an ink container 80 of an office machine 8 (FIGS. 4-6) for automatically filling the ink 88 into the ink container 80 of the office machine 8 and for maintaining the ink container 80 in the full or filled level. The ink reservoir 10 of the ink filling device includes a chamber 11 formed therein for receiving or containing the ink 88 therein and for supplying the ink 88 to the ink container 80 and for maintaining the ink container 80 in the full or filled level, and includes a cover 20 attached or mounted or secured onto the upper portion of the ink reservoir 10 for enclosing or sealing the ink reservoir 10.

The cover 20 or the ink reservoir 10 includes an inlet port 21 formed in the upper portion thereof for coupling to a refill ink cassette or bottle or casing 30 which is provided for receiving or containing the additional ink therein and for supplying the ink into the chamber 11 of the ink reservoir 10. For example, the refill ink casing 30 includes a cap 31 attached or coupled thereto, and includes a filling tube or member 32 extended from the cap 31 for engaging through the inlet port 21 of the cover 20 and into the chamber 11 of the ink reservoir 10 for supplying the ink into the chamber 11 of the ink reservoir 10, and a control valve 33 attached or coupled to the cap 31 or the filling tube or member 32 for controlling the ink from the refill ink casing 30 to the chamber 11 of the ink reservoir 10 (FIG. 6).

The cover 20 or the ink reservoir 10 further includes a number of outlet ports or openings 22 formed in the cover 20, and includes a number of outlet tubes 23 disposed or engaged into the chamber 11 of the ink reservoir 10 and attached or mounted or secured or coupled to the outlet ports or openings 22 respectively, and the outlet tubes 23 each include an upper portion or upper end or upper mouth piece 24 extended out of the cover 20 or the ink reservoir 10 for coupling to the ink containers 80 of the office machine 8 with a coupling or connecting device 5. The outlet tubes 23 each include a lower portion or lower end 25 spaced from a bottom wall 12 of the ink reservoir 10 for about 2 (two) to 3 (three) centimeters for preventing the dirt or contaminant received or contained in the chamber 11 of the ink reservoir 10 from entering or flowing out through the outlet tubes 23. A number of lids 26 (FIG. 4) may further be provided and attached or mounted or secured or coupled to the mouth pieces 24 of the outlet tubes 23 for selectively enclosing or blocking or sealing the mouth pieces 24 of the outlet tubes 23.

The connecting devices 5 each include a coupling pipe 50 having a first or lower end 51 for coupling or connecting to either of the outlet openings 22 of the cover 20 or the ink reservoir 10 or for coupling or connecting to either of the mouth pieces 24 of the outlet tubes 23, and having a second or upper end 52 for coupling or connecting to either of the ink containers 80 of the office machine 8, and having a control valve or quick coupler or quick coupling device 53 attached or mounted or secured or coupled to the coupling pipe 50 for allowing the ink reservoir 10 to be easily and quickly connected or coupled to the ink containers 80 of the office machine 8 respectively.

Figure 2:
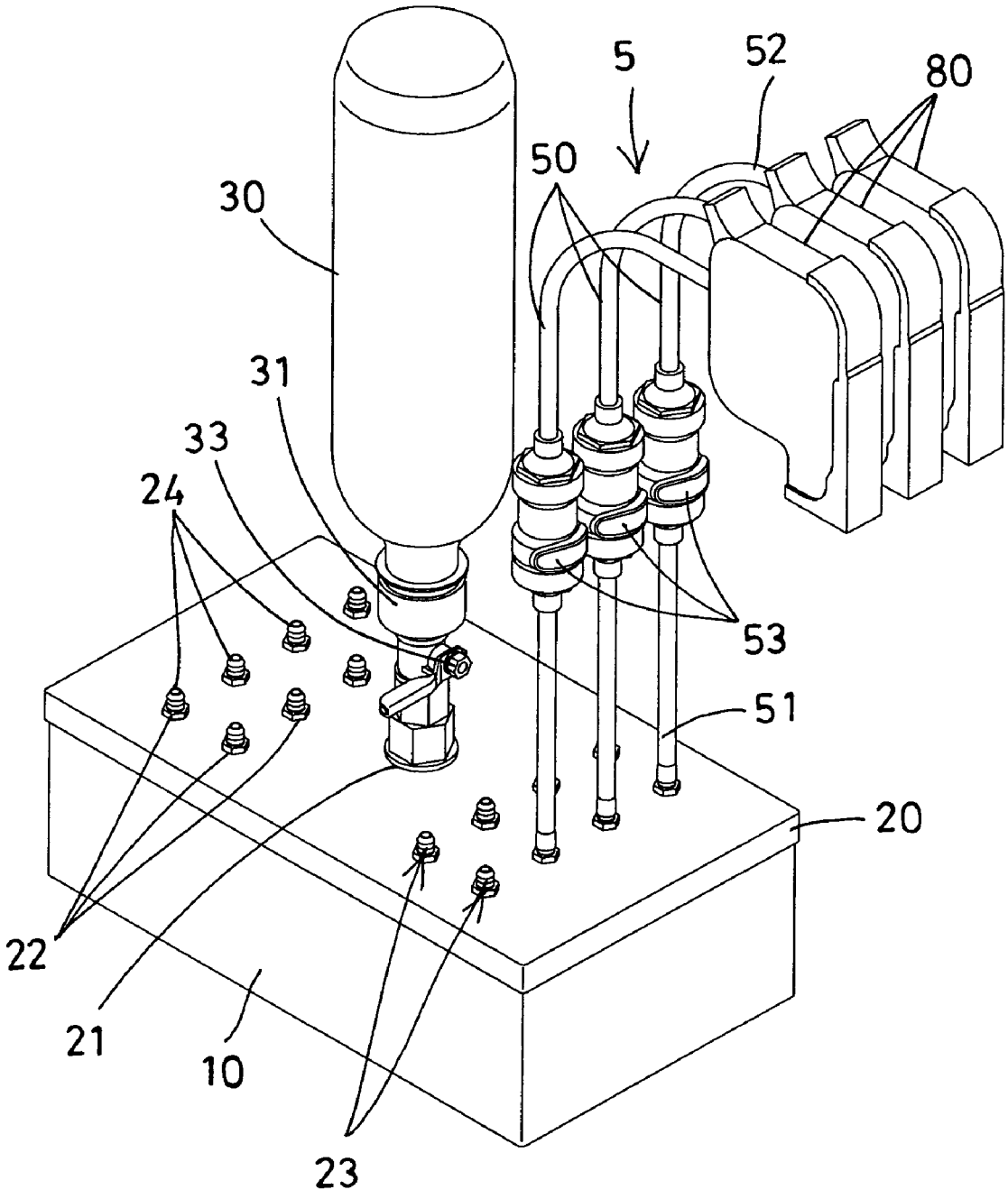
FIG. 2 is another perspective view similar to FIG. 1 illustrating the operation of the ink filling device.
Figure 3:
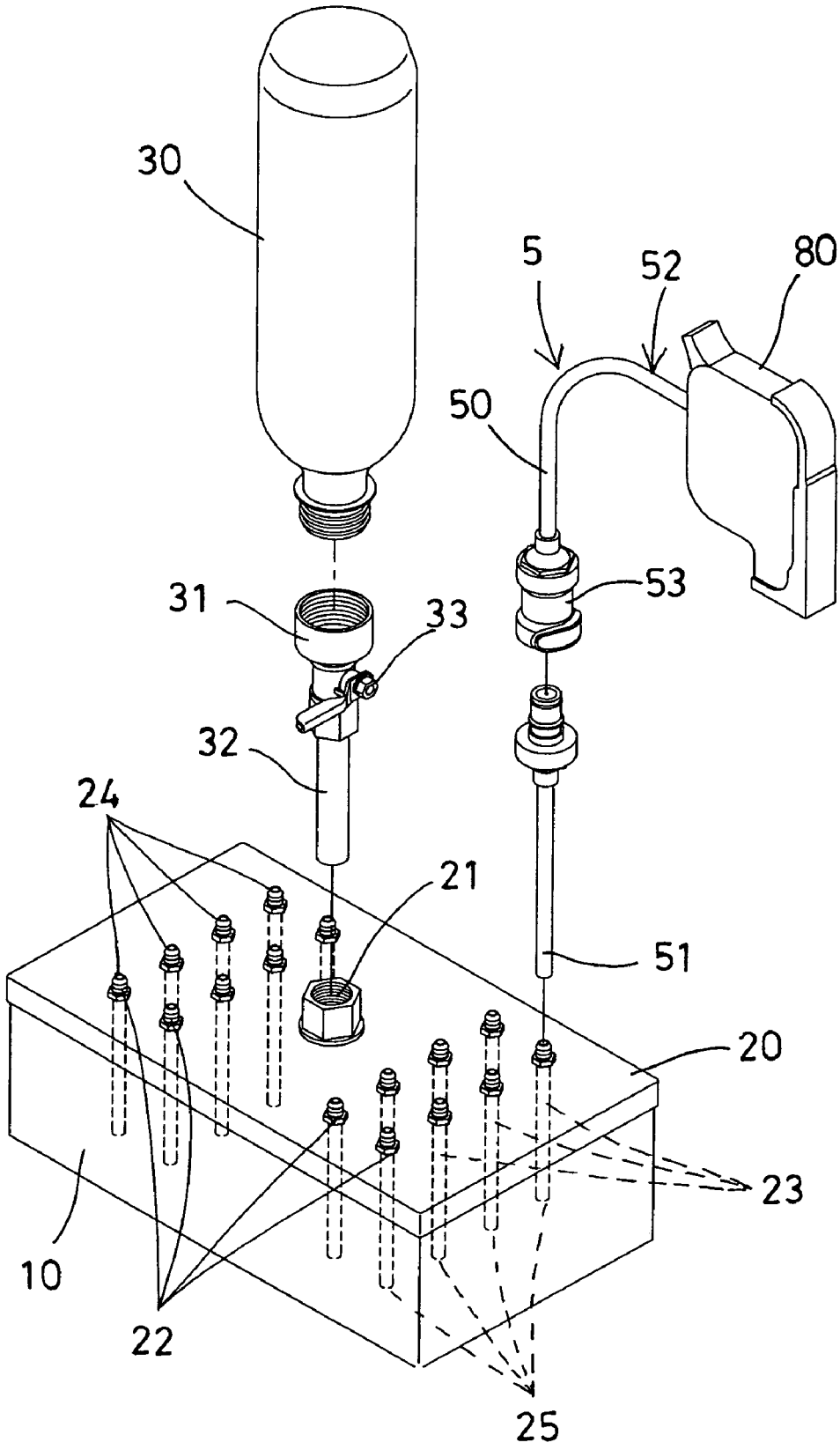
FIG. 3 is a partial exploded view of the ink filling device.
Figure 4:
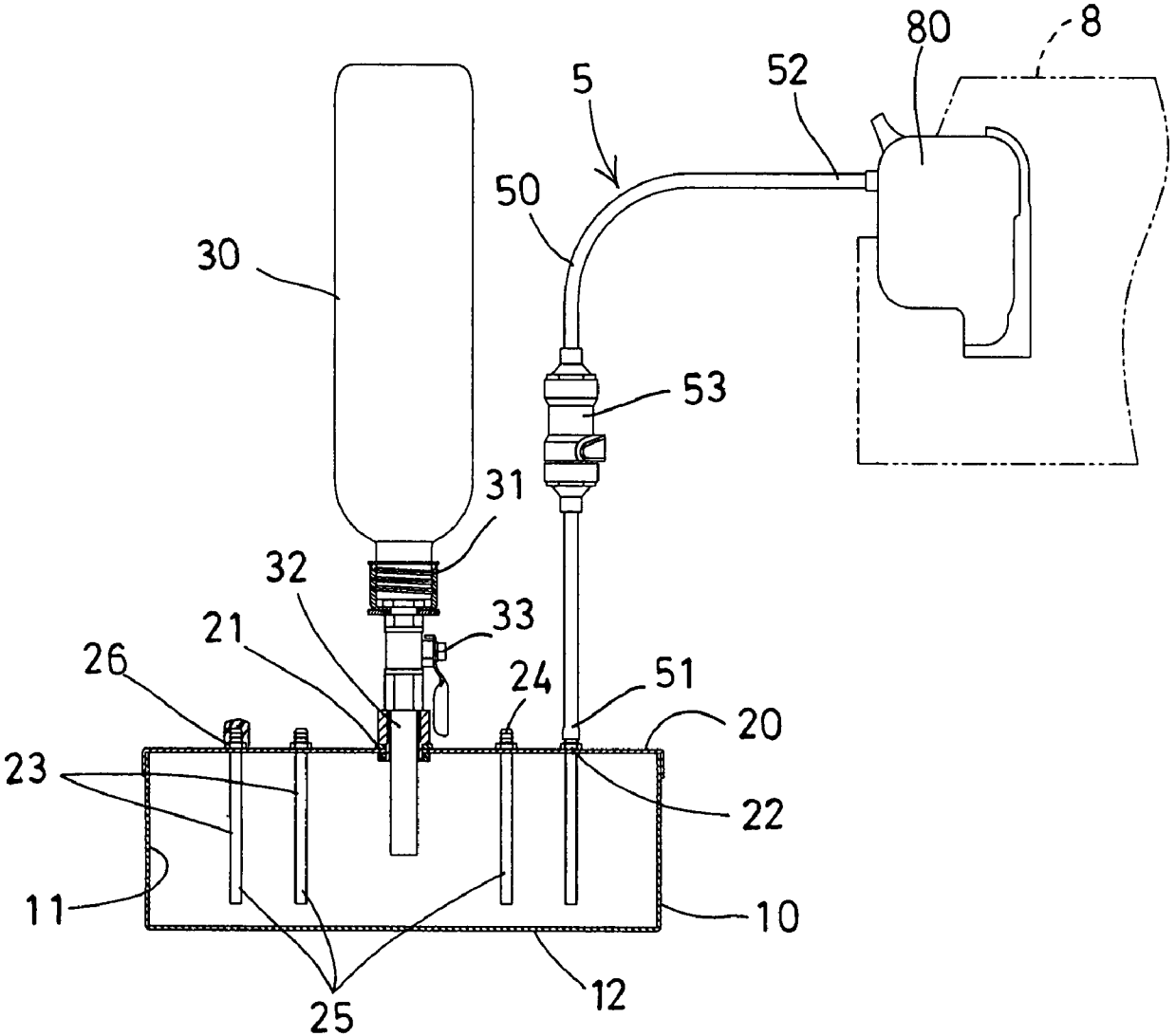
FIG. 4 is a partial cross sectional view of the ink filling device taken along lines 4-4 of FIG. 1.
Figure 5:
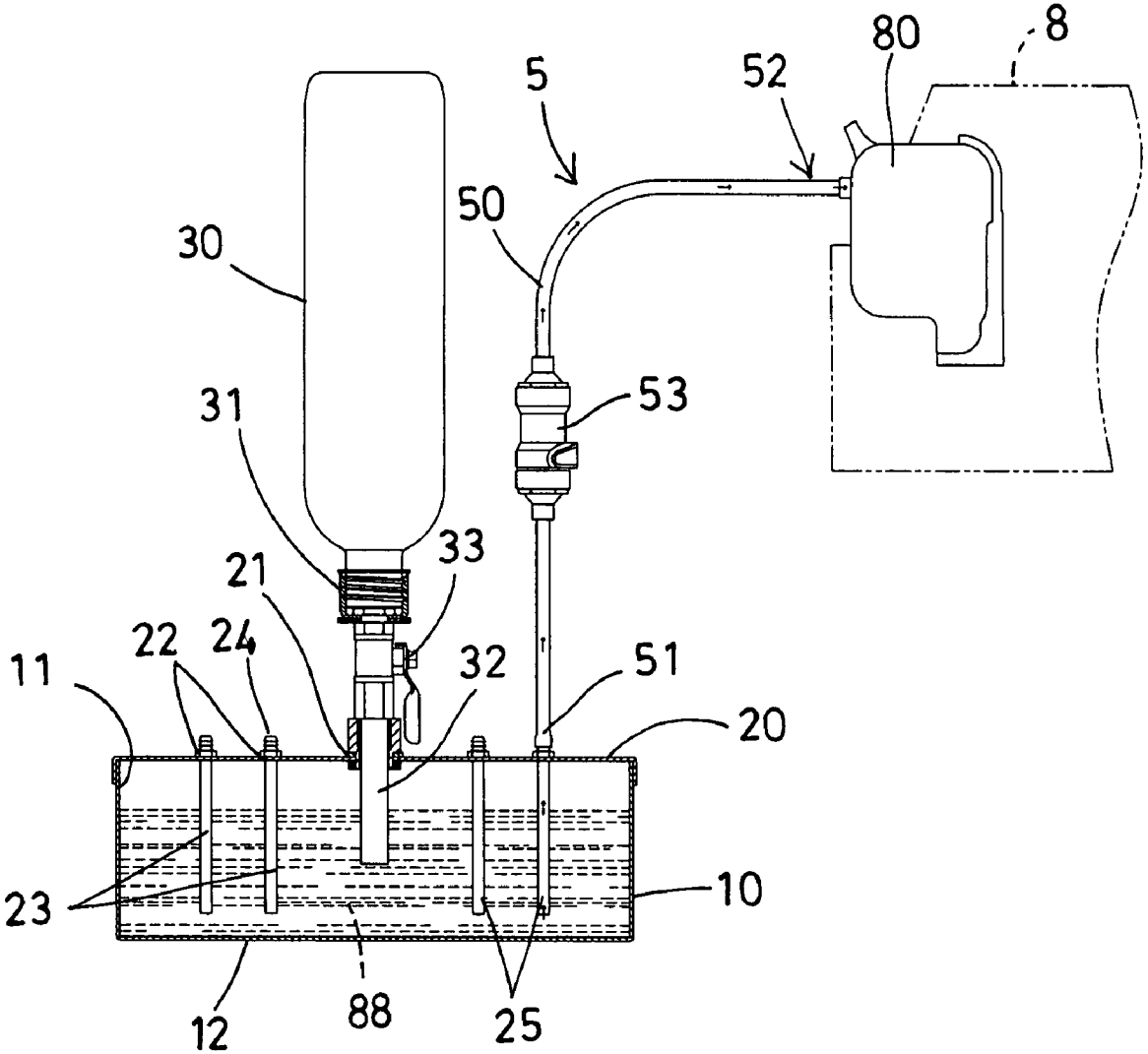
FIGS. 5 and 6 are partial cross sectional views similar to FIG. 4, illustrating the operation of the ink filling device for the office machine.
Figure 6:
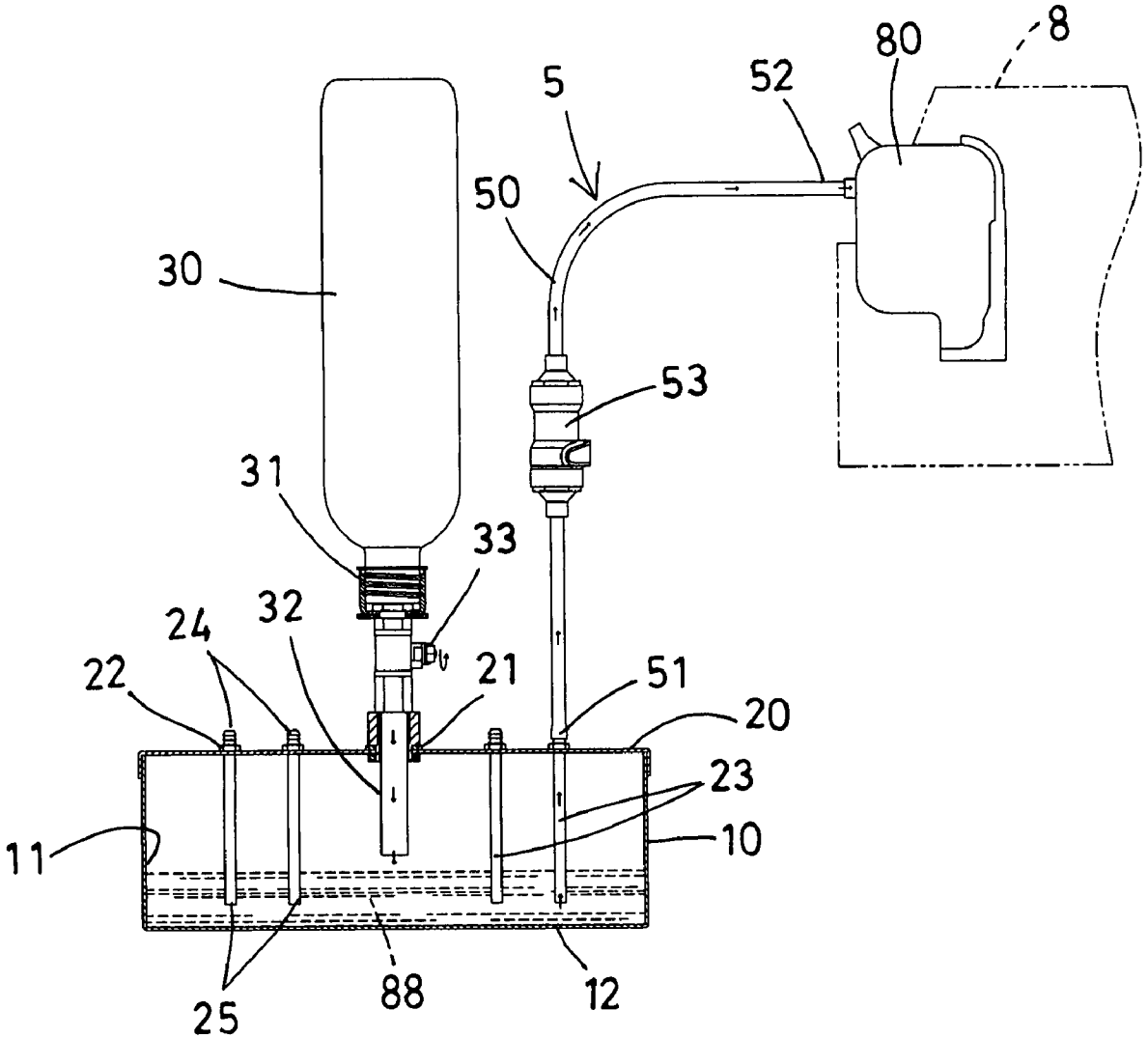

In operation, as shown in FIG. 6, the filling member 32 of the refill ink casing 30 may be selectively attached or connected or coupled to either of the outlet openings 22 of the cover 20 or of the ink reservoir 10 or to either of the mouth pieces 24 of the outlet tubes 23 for selectively supplying the ink into the chamber 11 of the ink reservoir 10, when required, and to maintain that the level of the ink 88 in the ink container 80 is higher than the lower ends 25 of the outlet tubes 23. As shown in FIGS. 2, 5, the ink 88 received or contained in the chamber 11 of the ink reservoir 10 may be coupled to one or more of the ink containers 80 of the office machine 8 with the connecting devices 5, and may be forced to flow into the coupling pipes 50 of the connecting devices 5 and into the ink containers 80 of the office machine 8 respectively due to the siphonic action, in order to maintain the ink containers 80 in the full or filled ink level.

It is to be noted that the users are not required to refill the ink containers 80 from times to times, and the ink containers 80 of the office machine 8 may be automatically filled with the ink without being operated by the users themselves and may be maintained in the full or filled ink level at all time, and will not interfere the typing or printing operation of the office machines, and may supply the ink to two or more ink containers 80 of the office machine 8 simultaneously.

Accordingly, the ink filling device in accordance with the present invention includes an ink reservoir coupled to an ink container of the office machine for automatically filling the ink container of the office machine and for maintaining the ink container in the full or filled level without being filled or operated by the users themselves.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An ink filling device for supplying an ink to an ink container of an office machine, said ink filling device comprising:

an ink reservoir including a chamber formed therein for receiving the ink therein, and including an inlet port, and including at least one outlet opening, and including a cover mounted on top of said ink reservoir for enclosing said ink reservoir, and including an outlet tube engaged into said chamber of said ink reservoir and coupled to said at least one outlet opening of said ink reservoir, said outlet tube including a mouth piece extended out of said cover for coupling to the ink container of the office machine, and said outlet tube including a lower end spaced from a bottom wall of said ink reservoir, and said ink reservoir including a lid for selectively attaching to said mouth piece of said outlet tube and for selectively enclosing and sealing said mouth piece of said outlet tube, an ink casing including a filling member for engaging with said inlet port and for supplying the ink into said chamber of said ink reservoir, and a connecting device including a coupling pipe having a first end for coupling to said at least one outlet opening of said ink reservoir, and having a second end for coupling to the ink container of the office machine.

2. The ink filling device as claimed in claim 1, wherein said inlet port and said at least one outlet opening are provided in said cover of said ink reservoir.

3. The ink filling device as claimed in claim 1, wherein said ink casing includes a cap attached thereto, and said filling member is extended from said cap, and said ink casing includes a control valve attached to said filling member for controlling the ink from said ink casing to said chamber of said ink reservoir.

4. The ink filling device as claimed in claim 1, wherein said connecting device includes a quick coupling device attached to said coupling pipe for quickly connecting said ink reservoir to the ink container of the office machine.

* * * * *